US007415812B2

(12) United States Patent
Bray et al.

(10) Patent No.: US 7,415,812 B2
(45) **Date of Patent: *Aug. 26, 2008**

(54) APPARATUS AND METHOD FOR PACKING SMOKING ARTICLES

(75) Inventors: Andrew Jonathan Bray, Southampton (GB); Alan Douglas Tearle, Southampton (GB); Steven Holford, Southampton (GB)

(73) Assignee: British American Tobacco (Investments) Limited, London (GB)

( * ) Notice: Subject to any disclaimer, the term of this patent is extended or adjusted under 35 U.S.C. 154(b) by 0 days.

This patent is subject to a terminal disclaimer.

(21) Appl. No.: 10/581,103

(22) PCT Filed: Nov. 30, 2004

(86) PCT No.: PCT/GB2004/005027

§ 371 (c)(1),
(2), (4) Date: Aug. 24, 2006

(87) PCT Pub. No.: WO2005/054056

PCT Pub. Date: Jun. 16, 2005

(65) Prior Publication Data

US 2007/0101683 A1 May 10, 2007

(30) Foreign Application Priority Data

Dec. 1, 2003 (GB) ..... 0327823.1
Mar. 8, 2004 (US) ..... 10/795,775

(51) Int. Cl.
*B65B 19/20* (2006.01)
*B65B 5/06* (2006.01)
*B65B 11/58* (2006.01)

(52) U.S. Cl. ..... 53/444; 53/449; 53/171; 53/148

(58) Field of Classification Search ..... 53/449, 53/171, 202, 444, 148, 149
See application file for complete search history.

(56) References Cited

U.S. PATENT DOCUMENTS

| | | | | |
|---|---|---|---|---|
| 1,161,455 | A * | 11/1915 | Craggs | 53/151 |
| 1,661,803 | A | 3/1928 | Kavel | |
| 1,795,666 | A * | 3/1931 | Molins | 53/443 |
| 1,926,493 | A * | 9/1933 | Molins et al. | 53/151 |
| 3,226,010 | A | 12/1965 | Rogers, Jr. | |
| 3,603,445 | A * | 9/1971 | Zausch et al. | 53/149 |
| 3,884,013 | A * | 5/1975 | Solomon | 53/467 |
| 4,184,591 | A | 1/1980 | Geldmacher | |

(Continued)

FOREIGN PATENT DOCUMENTS

DE 10256370 A1 6/2004

(Continued)

*Primary Examiner*—Stephen F Gerrity
(74) *Attorney, Agent, or Firm*—Charles I. Sherman; Middleton Reutlinger

(57) ABSTRACT

A method and apparatus for making a hinged lid side-by-side vertically hinged cigarette pack (10) having a first bundle (22) and a second bundle (23) of cigarettes is described. The machinery includes a first machine (30) to form a first foil wrapped bundle surrounded by a first inner frame, a second machine (31) for forming a second foil wrapped bundle surrounded by a second inner frame and a third machine (32) for combining the first and second foil wrapped bundle into a single hinged lid side-by-side vertically hinged pack.

42 Claims, 12 Drawing Sheets

U.S. PATENT DOCUMENTS

| | | | | | |
|---|---|---|---|---|---|
| 4,258,526 | A | | 3/1981 | Focke | |
| 4,265,073 | A | * | 5/1981 | Seragnoli | 53/171 |
| 4,631,900 | A | | 12/1986 | Mattei et al. | |
| 4,738,359 | A | | 4/1988 | Phillips, Jr. | |
| 4,947,624 | A | * | 8/1990 | Cones et al. | 53/540 |
| 5,046,295 | A | * | 9/1991 | Knecht | 53/202 |
| 5,058,363 | A | | 10/1991 | Focke et al. | |
| 5,143,213 | A | | 9/1992 | Moore et al. | |
| 5,158,178 | A | | 10/1992 | Cobler | |
| 5,160,023 | A | * | 11/1992 | Adams et al. | 53/448 |
| 5,174,443 | A | | 12/1992 | Chance et al. | |
| 5,174,444 | A | | 12/1992 | Adams et al. | |
| 5,178,270 | A | | 1/1993 | Adams et al. | |
| 5,180,056 | A | | 1/1993 | Adams et al. | |
| 5,193,674 | A | | 3/1993 | Cobler et al. | |
| 5,214,901 | A | * | 6/1993 | Milliner | 53/397 |
| 5,216,870 | A | * | 6/1993 | Boriani et al. | 53/202 |
| 5,461,842 | A | * | 10/1995 | Brizzi et al. | 53/234 |
| 5,473,862 | A | * | 12/1995 | Brizzi et al. | 53/447 |
| 5,588,281 | A | | 12/1996 | Boriani et al. | |
| 5,590,763 | A | | 1/1997 | Focke et al. | |
| 5,647,190 | A | * | 7/1997 | Minarelli et al. | 53/171 |
| 5,678,385 | A | * | 10/1997 | Focke et al. | 53/202 |
| 5,680,745 | A | * | 10/1997 | Brizzi et al. | 53/171 |
| 5,755,080 | A | * | 5/1998 | Draghetti et al. | 53/202 |
| 5,906,087 | A | | 5/1999 | Boldrini | |
| 5,996,309 | A | | 12/1999 | Focke et al. | |
| 6,035,612 | A | | 3/2000 | Draghetti et al. | |
| 6,047,526 | A | * | 4/2000 | Draghetti | 53/202 |
| 6,164,041 | A | | 12/2000 | Focke et al. | |
| 6,223,895 | B1 | | 5/2001 | Bowen et al. | |
| 6,230,966 | B1 | | 5/2001 | Beales et al. | |
| D492,815 | S | | 7/2004 | Bray et al. | |
| D495,824 | S | | 9/2004 | Bray et al. | |
| 6,837,369 | B2 | | 1/2005 | Amos | |
| 6,941,728 | B1 | * | 9/2005 | Bray et al. | 53/449 |

FOREIGN PATENT DOCUMENTS

| | | | |
|---|---|---|---|
| FR | 2614720 | | 11/1988 |
| WO | 2004080844 | A1 | 9/2004 |

* cited by examiner

APPARATUS AND METHOD FOR PACKING SMOKING ARTICLES

CROSS REFERENCE TO PRIOR APPLICATION

This application is a national stage filing (35 U.S.C. 371) of PCT/GB2004/005027, filed on Nov. 30, 2004, which claims priority to and benefit from Great Britain Patent Application No. 0327823.1, filed on Dec. 1, 2003, currently pending. PCT/GB2004/005027 also claims priority to and benefit from U.S. patent application Ser. No. 10/795,775, filed on Mar. 8, 2004, now U.S. Pat. No. 6,941,728, issued on Sep. 13, 2005.

BACKGROUND OF THE INVENTION

This invention relates to apparatus and methods for packaging smoking articles such as cigars, cigarillos and cigarettes, all of which articles will be referred to herein for simplicity as "cigarettes".

The present invention is concerned, in particular, with a cigarette wrapping machine which forms a hinged lid, hinged side-by-side carton or pack of cigarettes wherein a first foil wrapped bundle is placed in hinged side-by-side relationship with a second foil wrapped bundle, an example of such a carton or pack being described in our co-pending application WO 2004/080844, which application is incorporated herein by reference.

WO 2004/080844 describes a smoking article blank, the blank comprising a lid portion and a base portion, the lid portion and the base portion being interconnected along a hinge line and the base portion comprising a first main panel, a second main panel and a bottom panel, each panel being defined by longitudinal side margins, the first and the second main panels each having side panels, which side panels depend from the longitudinal margins of the first and second main panels, at least one of the side panels having a side flap depending from a longitudinal margin thereof, the bottom panel having a line of perforation extending between the longitudinal margins thereof, and the side flap being connected to the adjacent side panel by a hinge line. There is also provided a plurality of inner blanks, which inner blanks may be used in combination with the above-describe smoking article blank. When erected, each inner blank is capable of enwrapping a bundle of smoking articles

SUMMARY OF THE INVENTION

The system of the present invention provides for a cigarette packing machine, the machine consisting of three separate units or machines, a first cigarette wrapping unit, a second cigarette wrapping unit and a third pack combining unit. The system of the present invention provides for creation of a first and a second foil wrapped inner frame bundle for combining at a subsequent unit which partially surrounds them with an outer frame having a hinged lid. The outer frame member also provides for a side hinge and a separable bottom wall such that each of the individual wrapped bundles may be hinged along a given adjoining line.

The present invention provides an apparatus for forming a cigarette pack comprising three units, a first cigarette wrapping unit, a second cigarette wrapping unit and a third pack combining unit, wherein the first cigarette wrapping unit is operable to assemble a first inner frame blank member A about a first bundle of cigarettes, the second cigarette wrapping unit is operable to assemble a second inner frame blank member B about a second bundle of cigarettes, and the third pack combining unit is operable to assemble an outer blank member C about a pack assembly, which pack assembly AB comprises assembled blanks A and B.

Preferably the first cigarette wrapping unit, second cigarette wrapping unit and the third pack combining unit are provided by separate cigarette packing machines.

In an alternative arrangement the first and the second cigarette wrapping units may be provided by a single unit operable to assemble a first inner blank member A about a first bundle of cigarettes and a second inner blank member B about a second bundle of cigarettes.

Preferably the third pack combining unit is configured to receive the first assembled cigarette bundle and the second assembled cigarette bundle in face-to-face overlaying relationship. The first assembled cigarette bundle comprises the first bundle of cigarettes surrounded by the first inner frame blank member A and the second assembled cigarette bundle comprises the second bundle of cigarettes surrounded by the second inner frame blank member B.

Advantageously the third pack combining unit is operable to assemble the outer frame member C about the pack assembly AB, which pack assembly AB comprises the first and the second assembled cigarette bundle, said outer frame member C having a hinge line along a mating side edge of the first assembled cigarette bundle and the second assembled cigarette bundle.

It will be understood that in advance of either of inner frame blank members A or B being assembled about the first or the second bundle of cigarettes respectively, the bundle of cigarettes is preferably wrapped in a wrapping material. Advantageously the wrapping material is foil. In the case where the bundle of cigarettes is initially wrapped in a wrapping material the first and/or the second assembled cigarette bundles further comprise the wrapping material.

Preferably the first and the second cigarette wrapping units and the third pack combining unit of the present invention utilise cigarette packing machines of similar designs. It will be understood by the skilled artisan that each of the first and the second cigarette wrapping units or the pack combining machine may be modified according to the desired combination of cigarettes to be eventually wrapped in the hinged lid pack, but in the present design the first and the second cigarette wrapping units are utilised to form a thirteen cigarette bundle and a seven cigarette bundle.

Preferably the first cigarette wrapping unit and the second cigarette wrapping unit each comprise a cigarette receiving station, a foil wrapping station, an inner frame blank conveyor, a folding station and a transferring conveyor.

Advantageously the first cigarette wrapping unit and the second cigarette wrapping unit may further comprise a drying drum.

In use, cigarettes are initially fed into the cigarette wrapping unit at the cigarette receiving station. The cigarettes at the cigarette receiving station are then lined up and placed onto a cigarette conveyor to be combined as necessary and thereafter fed into the foil wrapping station. Suitably the foil wrapping station utilises foil drawn from a bobbin such that the foil wraps the requisite cigarette bundle as necessary and also applies the necessary perforations along an upper section thereof as is standard practice in the art. Due to the perforations placed in the upper portions of the foil, the upper section of the foil wrap may be removed by the consumer upon initial opening of the cigarette pack.

Preferably, in both the first and the second cigarette wrapping unit, the foil wrapped bundle is then conveyed to an individual folding station in the inner frame blank conveyor.

Preferably the first and/or the second cigarette wrapping machine may further comprise an indexed advancing mechanism whereby the wrapped bundle of cigarettes may be advanced into the individual folding station.

It is much by preference that both the first and the second cigarette wrapping unit further comprise a blank feed from which an inner frame blank member A or B may be conveyed into the individual folding station in the inner frame blank conveyor.

Suitably the individual folding station may comprise a rounded pocket, a square pocket or a bevelled pocket such that the shape of the pocket is suitable for an inner frame blank member A or B having rounded, square or bevelled longitudinal margins.

Preferably the inner frame blank member A and the inner frame blank member B are folded about the wrapped bundles of cigarettes within the first and the second cigarette wrapping machines respectively thereby forming the first and the second assembled cigarette bundles.

Advantageously, in operation, prior to insertion of the wrapped bundle of cigarettes into the inner frame blank conveyor, the side walls of the individual inner frame blank member are upturned by the appropriate folding mechanism. Additionally, it is much by preference that a small dot or placement of adhesive may be utilised to affix the wrapped bundle of cigarettes onto the flat face of the inner frame blank member. The inner frame blank conveyor is operable to convey the adjoined wrapped bundle of cigarettes and inner frame blank member to the appropriate folding stations. Suitably a second spot or placement of adhesive may be placed on the opposing flat planar surface of the inner frame blank member such that the wrapped bundle of cigarettes is securely affixed to both the front and the back surface of the inner frame blank member. The assembled cigarette bundle comprising the combined inner frame blank member and wrapped bundle of cigarettes is folded appropriately on all sides and adhesive is applied where necessary to assure that the folding flaps are maintained in their position. The side member folding operation may then take place prior to insertion of the assembled cigarette bundle into the heated drying drum (if present).

Advantageously either the first cigarette wrapping machine or the second cigarette wrapping unit further comprises an inverting station, whereby the assembled cigarette bundle is inverted before being conveyed by the transfer conveyor to the third pack combining unit.

It is much by preference that the inverting station is a portion of the transfer conveyor whereby the assembled cigarette bundle is inverted through 180° in an arcuate feed path. Preferably the inversion of the assembled cigarette bundle occurs under the action of gravity.

It is much by preference that the transfer conveyors of the first cigarette wrapping unit and the second cigarette wrapping machine are each operable to convey the assembled cigarette bundles to the third pack combining unit.

Advantageously the transfer conveyors of the first cigarette wrapping unit and the second cigarette wrapping unit are adjacent one another in offset, parallel relation. Suitably the transfer conveyor of the second cigarette wrapping unit is positioned to be lower than the transfer conveyor of the first cigarette wrapping machine. Alternatively, it will be readily understood that the transfer conveyor of the first cigarette wrapping machine may be positioned lower than the transfer conveyor of the second cigarette wrapping machine.

Preferably the third pack combining unit comprises a conveyor transfer station having a first transfer plunger and a second transfer plunger, the first transfer plunger crossing a conveyor line from the first cigarette wrapping unit, the second transfer plunger crossing a conveyor line from the second cigarette wrapping machine, whereby both the first and the second transfer plungers are operable to deposit assembled cigarette bundles A and/or B onto a combination conveyor thereby forming pack assembly AB.

It is much by preference that the third pack combining unit comprises a blank feed from which an outer frame blank member C may be fed into a folding station.

In use, the third pack combining unit receives the assembled cigarette bundles as pack assembly AB. An outer frame blank member C is placed around the combined face-to-face positioned assembled cigarette bundles (pack assembly AB) and outer frame blank member C is folded about the pack assembly AB, thereby forming a hinged lid pack having a vertical side hinge.

Advantageously the third pack combining unit further comprises a cutting device which cutting device is operable to cut the outer frame blank member C along the bottom wall thereof to allow opening of the hinged lid pack along the vertical hinge line. It is much by preference that the cutting device is a knife.

The formed pack has a hinged lid and the assembled cigarette bundles are separable by virtual of the vertical hinge line. The third pack combining unit is operable to apply a long hinge panel or flap, being part of outer frame blank member C, which may be adhesively applied to a side wall of one of the assembled cigarette bundles A or B. The hinge panel further comprises a score or hinge line to allow the individual assembled cigarette bundles to hinge thereabout in the hinged lid pack.

Preferably the third pack combining unit further comprises an end sealing device. More preferably the end sealing device is a foam belt. Even more preferably the end sealing device is a continuous belt. The end sealing device is operable to ensure that the bottom wall of the outer frame blank C adheres to the bottom walls of the assembled cigarette bundles.

Preferably the transfer conveyors of the first and the second cigarette wrapping units each further comprise sensors whereby the sensors are operable to detect a shortage of assembled cigarette bundles A and/or B on the transfer conveyors. When referred to herein a "shortage of assemble cigarette bundles A and/or B on the transfer conveyors" shall be taken to mean that there should be a substantially equal number of assembled cigarette bundles A and B such that assembly AB may be formed. It is much by preference that the sensors are in communication with the first and second cigarette wrapping units and the third pack combining unit such that the operating speeds of the units are controlled in accordance with a supply-demand relationship for the assembled cigarette bundles in each of the three units.

The present invention further provides a method of assembly of a cigarette pack wherein the pack is a hinged lid side-by-side vertically hinged cigarette pack, the method comprising forming a first wrapped bundle of cigarettes having a first inner frame member A, forming a second wrapped bundle of cigarettes having a second inner frame member B, transporting said first wrapped bundle of cigarettes and said second wrapped bundle of cigarettes to a pack combining unit in combined relationship as a pack assembly AB, and assembling an outer frame blank member C about the pack assembly AB.

Preferably the first wrapped bundle of cigarettes having a first inner frame member A, that is the first assemble cigarette bundle, is formed on a first cigarette wrapping unit in which a first bundle of cigarettes is wrapped in a wrapper, a first inner blank member A is fed to a folding station in the first cigarette wrapping unit and partially erected, the first of wrapped bundle of cigarettes is plunged into the partially erected first inner blank member A, and the partially erected first inner blank member A is completely erected about the first wrapped bundle of cigarettes.

Preferably the second wrapped bundle of cigarettes having a second inner frame member B, that is the second assembled cigarette bundle, is formed on a second cigarette wrapping unit in which a second bundle of cigarettes is wrapped in a wrapper, a second inner blank member B is fed to a folding station in the second cigarette wrapping unit and partially erected, the second wrapped bundle of cigarettes is plunged into the partially erected second inner blank member B, and the partially erected second inner blank member B is completely erected about the second wrapped bundle of cigarettes.

It is much by preference that outer blank member C is formed about pack assembly AB on the third pack combining unit by partially erecting outer blank member C, plunging pack assembly AB into the partially erected outer blank member C and completely erecting the outer blank member C about the pack assembly AB.

Advantageously when outer blank member C is partially erected about pack assembly AB, a vertical hinge panel of the outer blank member C is adhesively applied to the first assembled cigarette bundle of pack assembly AB thereby allowing the pack assembly AB to hinge about a vertical hinge line.

Advantageously the method of the present invention further comprises cutting a bottom panel of the outer blank member C in half to allow the first assembled cigarette bundle and the second assembled cigarette bundle to separate about the vertical hinge line.

Preferably the first assembled cigarette bundle comprises seven cigarettes. Preferably the second assembled cigarette bundle comprises thirteen cigarettes.

It is much by preference that the first and the second assembled cigarette bundles further comprise a wrapping material wrapped about the bundle of cigarettes. More preferably the wrapping material is a foil.

BRIEF DESCRIPTION OF THE SEVERAL VIEWS OF THE DRAWINGS

In order that the invention be easily understood and readily carried into effect, reference will now be made, by way of example, to the accompanying diagrammatic drawings in which.

DETAILED DESCRIPTION OF THE INVENTION

Figure 1:
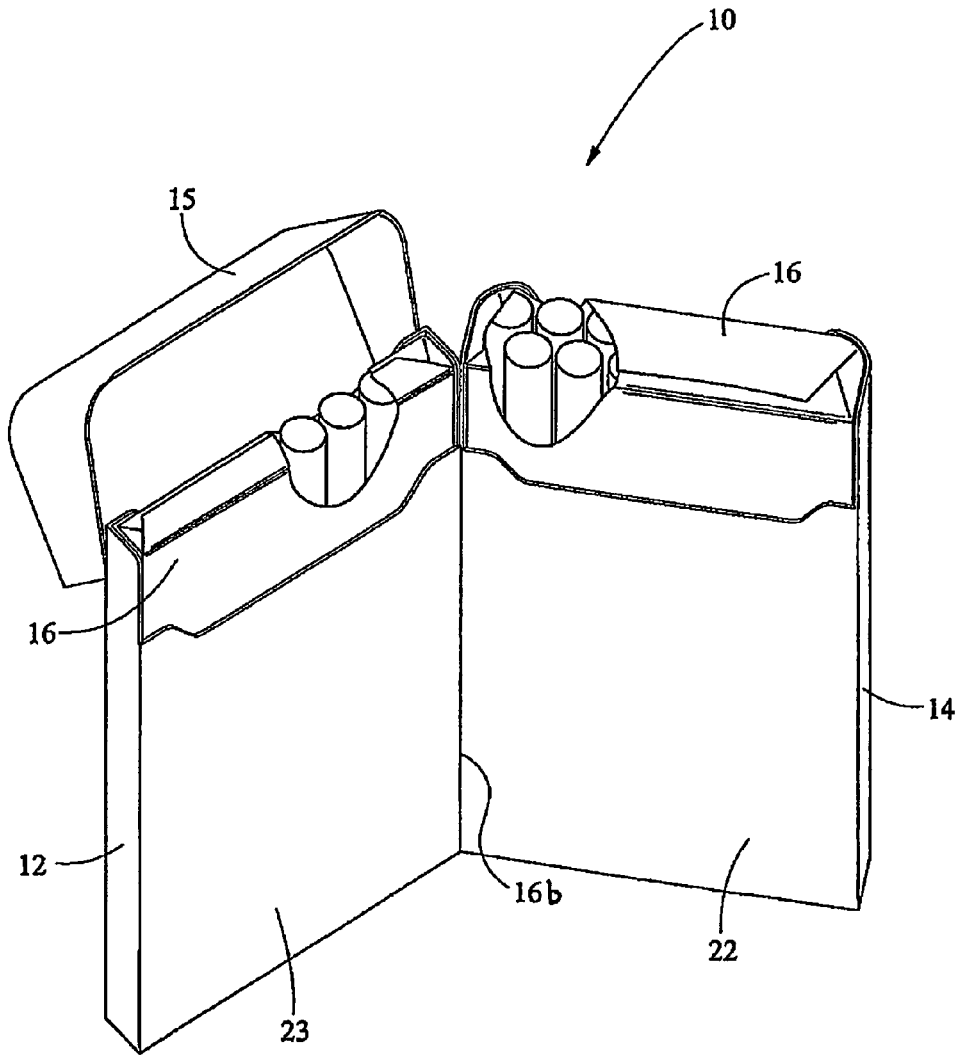
FIG. 1 is a perspective view of a hinged side by side pack of the present invention.
Figure 7:
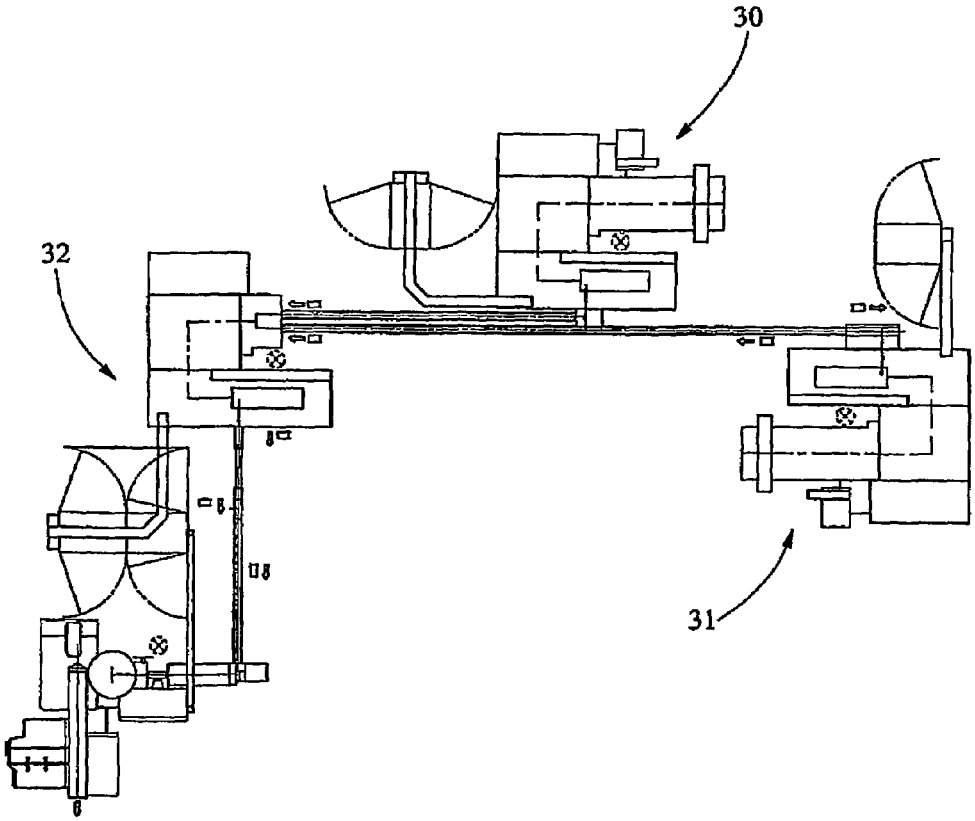
FIG. 7 is a top plan layout view of the cigarette wrapping units which form part of the present invention.
Figure 8:
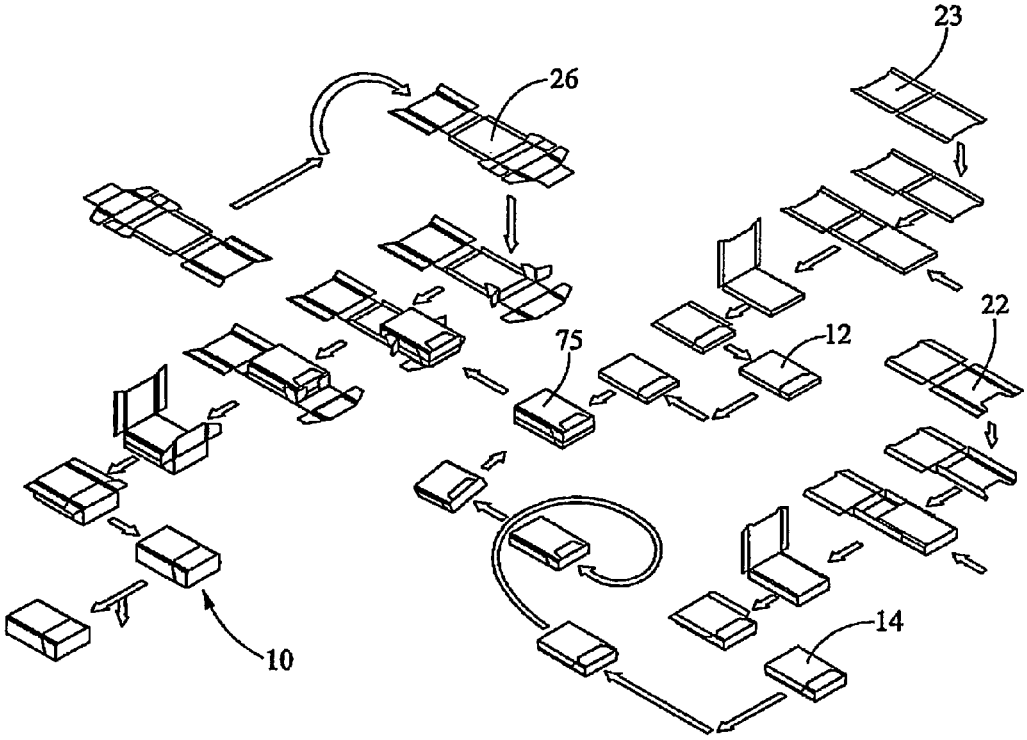
FIG. 8 is a schematic view of the bundle of wrapped cigarette paths used in the present invention.

Shown in FIG. 1 is the hinged lid side-by-side hinged pack 10 of the present invention. The machinery which creates the hinged lid side-by-side hinged cigarette pack 10 is comprised of three different machines, Hinged Lid Packer (HLP 1) or first cigarette wrapping machine 30, HLP 2 or second cigarette wrapping machine 31 and HLP 3 or third cigarette packing machine 32, shown in FIG. 7. Both of HLP 1 30 and HLP 2 31 are designed to create individual foil wrapped cigarette bundles which are wrapped in inner frames and then wrapped in an outer frame in the HLP 3 32 machine.

Figure 3:
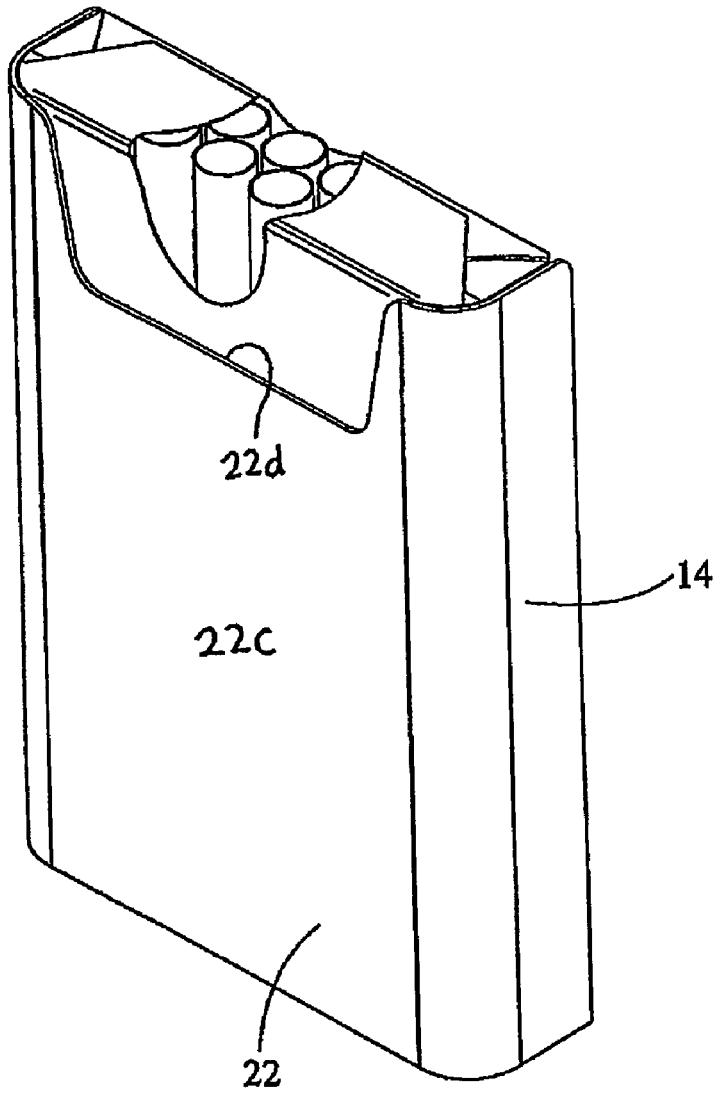
FIG. 3 is a perspective partial cut away view of the second bundle of wrapped cigarettes formed by the cigarette wrapping unit of the present invention.

HLP 2 31 can be utilised, as set forth herein, to make thirteen cigarette bundle 14, shown in FIGS. 1 and 3. HLP 2 32 creates the thirteen cigarette bundle 14 by first placing six and seven stacked cigarette rows together on a cigarette alignment conveyor 53, shown in FIG. 9, wrapping the stacked cigarettes with foil 54 and then surrounding the foil with an inner frame 23 for an exemplary thirteen cigarette bundle 14.

Similarly, HLP 1 30 can be utilised to form a single row of seven cigarettes, wrap these cigarettes in a foil lining 16, place this seven cigarette bundle onto the blank conveyor, the bundle then being partially surrounded by the inner frame 23 for the seven cigarette bundle 12.

Both of the inner frame wrapped cardboard bundles 12, 14 are axially aligned as inner frame cartons and then wrapped in an outer frame 26 in HLP 3 32. Thus, after manufacturing of both the thirteen's cigarette bundle and the seven's cigarette bundle packs, both bundles are forwarded to HLP 3 32 and are combined with the outer frame or outer carton member 26 which is folded around the two foil wrapped bundles 12, 14, glued at the proper seams, and then cut along the bottom panel 27 so that it may open along the vertical hinge line 16 at the side of the assembled pack.

Figure 9:
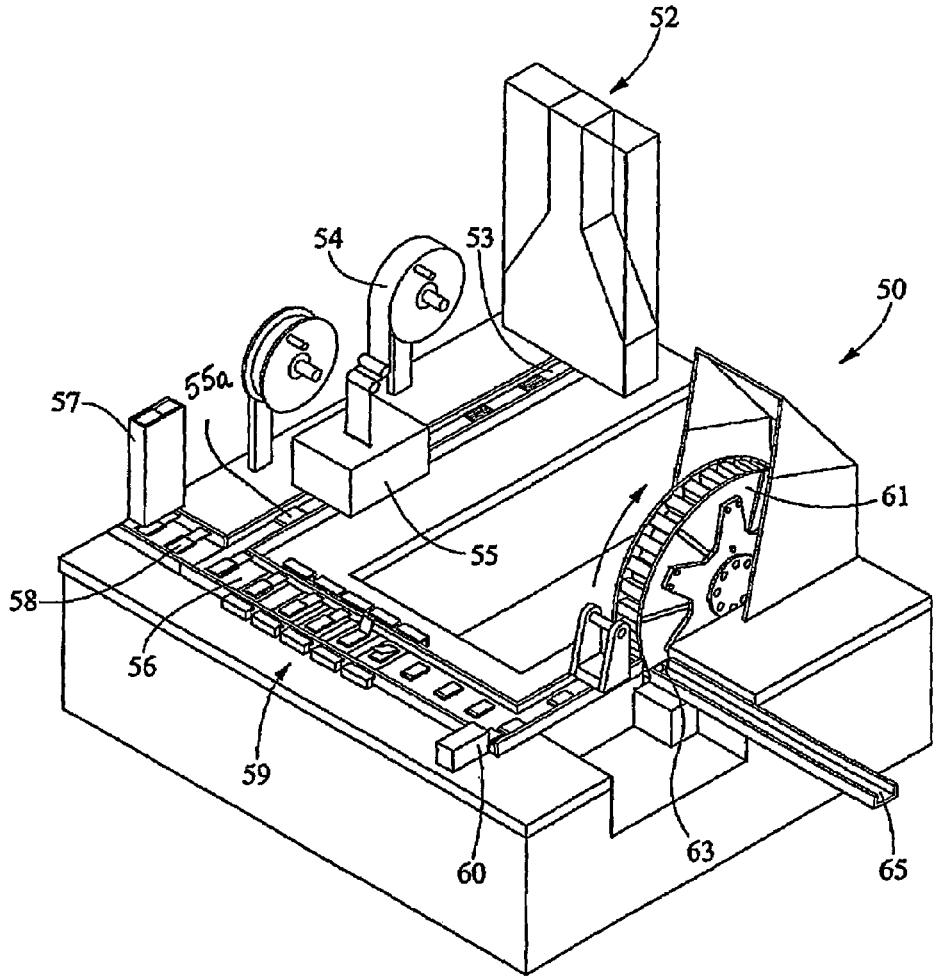
FIG. 9 is a top perspective view of the cigarette wrapping units of the present invention for creation of the separate inner frame wrapped bundles.
Figure 10:
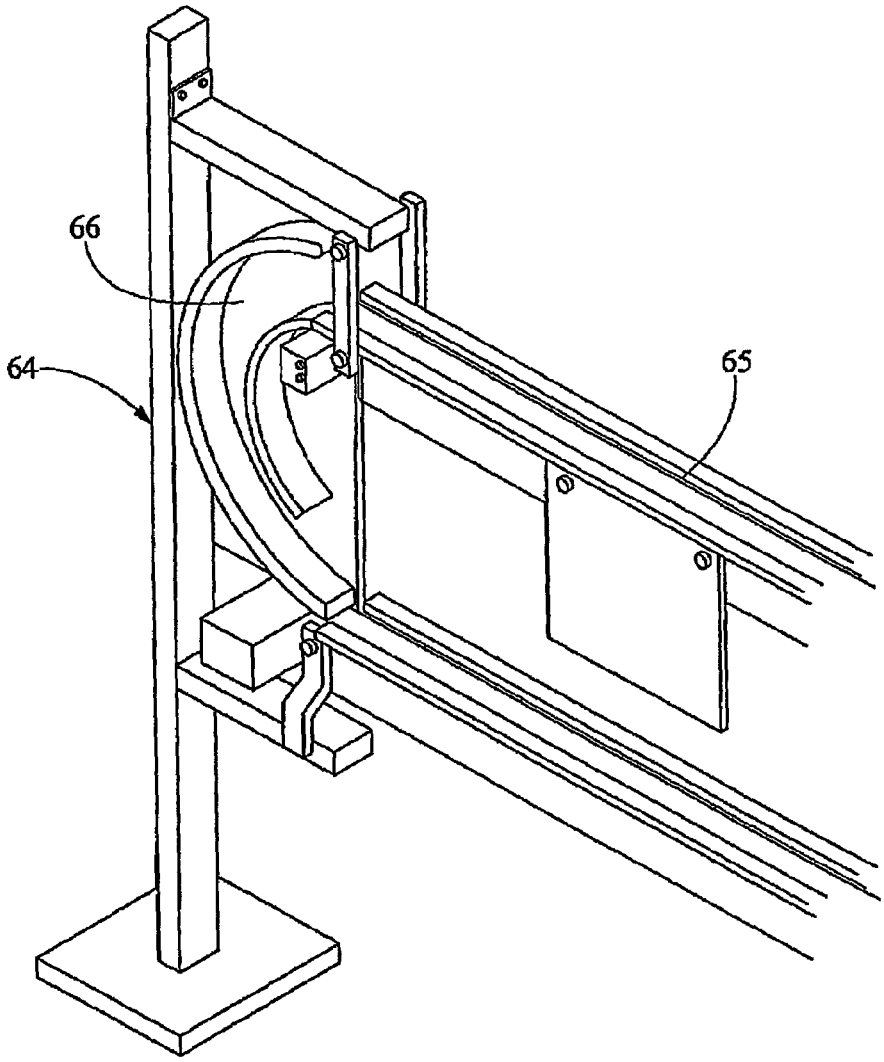
FIG. 10 is a perspective view of the inverting station for one of the exit conveyors of the present invention.

In operation, both HLP 1 30 and HLP 2 31 work very similarly for creation of the first and the second foil wrapped cigarette bundles 12, 14. Thus, explanation for the cigarette wrapping machines herein applies to each of the first and second machines. Referring to FIG. 9, cigarettes are fed to the cigarette wrapping machine 50 through a cigarette intake chute 52. The cigarettes are aligned by the alignment conveyor 53 to prepare the cigarettes for individual bundle formation. Foil wrap 54 is fed from a spool or bobbin for wrapping of the cigarette bundle in a foil wrap station 55. The cigarette bundle may be formed in either a seven or thirteen bundle as previously indicated in the present pack design but many other alternative constructions and cigarette counts are readily available for use in the present hinged lid pack design.

The cigarette bundle is forwarded by the cigarette alignment conveyor 53 to the foil wrapping station 55 where foil 54 is unrolled off s foil roll suspended, from above such that the cigarette bundle is wrapped appropriately in foil. The foil wrapped bundle 55*a* is then forwarded to the inner frame blank conveyor 56. In the blank conveyor 56 are located individual folding stations which receive cigarette carton inner blanks 58 from the inner frame blank chute 57. Prior to a foil wrap bundle 55*a* being inserted into the individual folding station on the blank conveyor 56 which has an inner blank inserted therein, a small dot of adhesive may be applied to a front flat planar surface such that the cigarette bundle 55*a* remains stationary thereon. After placement of the foil wrapped bundle 55*a* into the individual inner blank 58 in the blank conveyor 56, the folding operations begin for folding of the inner frame blank 58 around the foil bundle 55*a*. A second dot of adhesive may be placed on the opposing flat surface of the inner frame blank 58 to secure the foil wrapped bundle 55*a* within the inner frame 58. After placement of the second adhesive dot on the interior wall of the inner frame, the inner frame 58 is folded around the foil wrapped bundle 55*a* in the folding and adhesive application stations 59 and the formed inner frame foil wrapped cigarette bundle is passed through an inspection station where improperly folded inner frame members are rejected. After the inspection station, the individual packs are passed by the conveyor which moves the foil wrapped bundle from the individual stations of the blank conveyor 56 to a drum application of adhesive so that an adhesive is applied to the long side seams for the folding operation of the sides or seams. After the long sides are folded, the now formed inner frame with the foil wrapped cigarette bundle (12, 14) located therein is passed into the drying drum 61 by the plunger 60 which allows the long side seam adhesive to dry before the pack is removed from the drum 61 and passed to an exit conveyor 65 through an exit aperture 63 formed in the drum 61. Thus, subsequent to the drying drum 61, the fully formed inner frame cigarette bundles 12 and 14 depicted in FIGS. 2 and 3, are positioned properly and ready for advancement to cigarette wrapping machine HLP 3 32 for creation of the outer frame and hinged lid of the pack.

Figure 5:
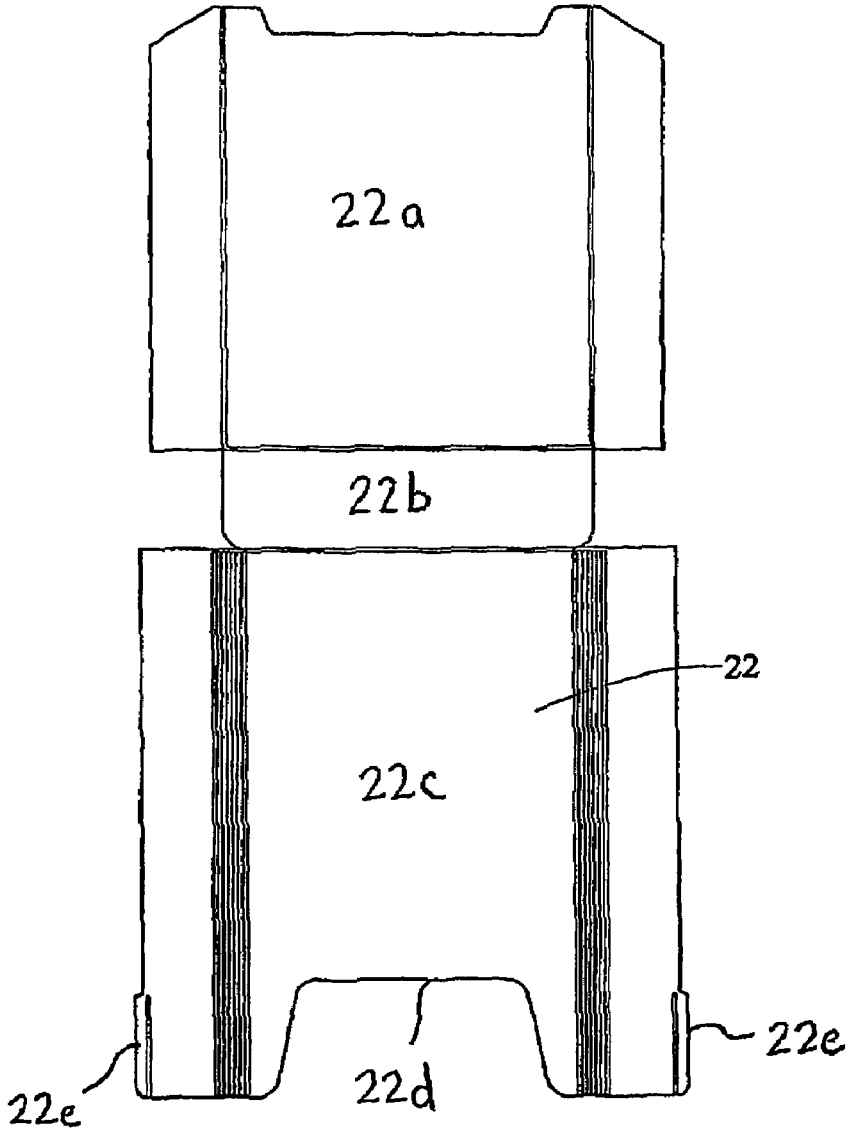
FIG. 5 is a plan view of one of the inner frame members used by the cigarette wrapping unit of the present invention for creating one of the assembled cigarette bundles.

In both the first cigarette wrapping machine 30 and the second cigarette wrapping machine 31, HLP 1 and HLP 2, the system generally utilises the same process for formation of the individual foil wrapped cigarette bundles, namely the seven cigarette bundle and the thirteen cigarette bundle. The cigarettes are funnelled into the wrapping machine and the inner frame is wrapped or formed there around. Each of the inner frame surrounded foil wrapped cigarette bundles 12 and 14, as shown in FIGS. 2 and 3, are formed with the respective inner frame blanks 22 and 23 shown in FIGS. 5 and 6. In FIG. 5, the thirteen's inner frame 22 is shown wherein an inner face member 22*a*, bottom wall 22*b* and outer face 22*c* is shown and is formed in the second cigarette wrapping machine 31 (HLP 2). Further, a cutout 22*d* is also formed in the inner frame blank. As can be seen in the fully formed thirteen's bundle 14 of FIG. 3, the inner frame 22 covers almost the entirety of the foil wrapped cigarette bundle. The cutout section 22*d* is formed such that the foil can be grasped from the outside of the wall of the pack 10 without the two individual bundles 14 and 12 being separated about vertical hinge line 16*b*, shown in FIG. 1.

Figure 2:
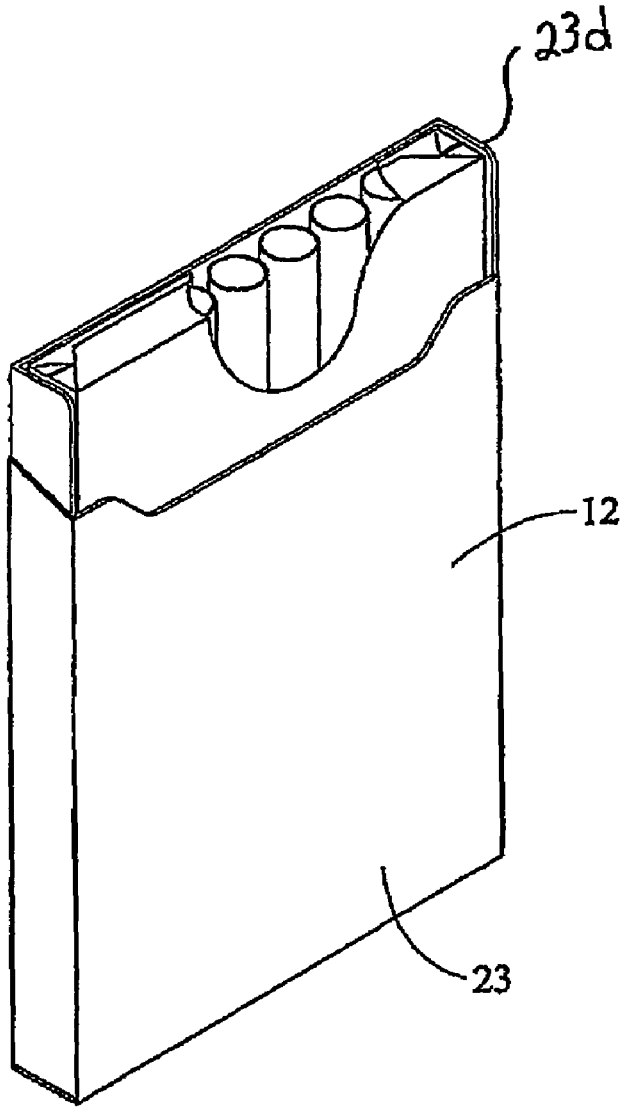
FIG. 2 is a perspective partial cut away view of the first bundle of wrapped cigarettes formed by the cigarette wrapping unit of the present invention.
Figure 4:
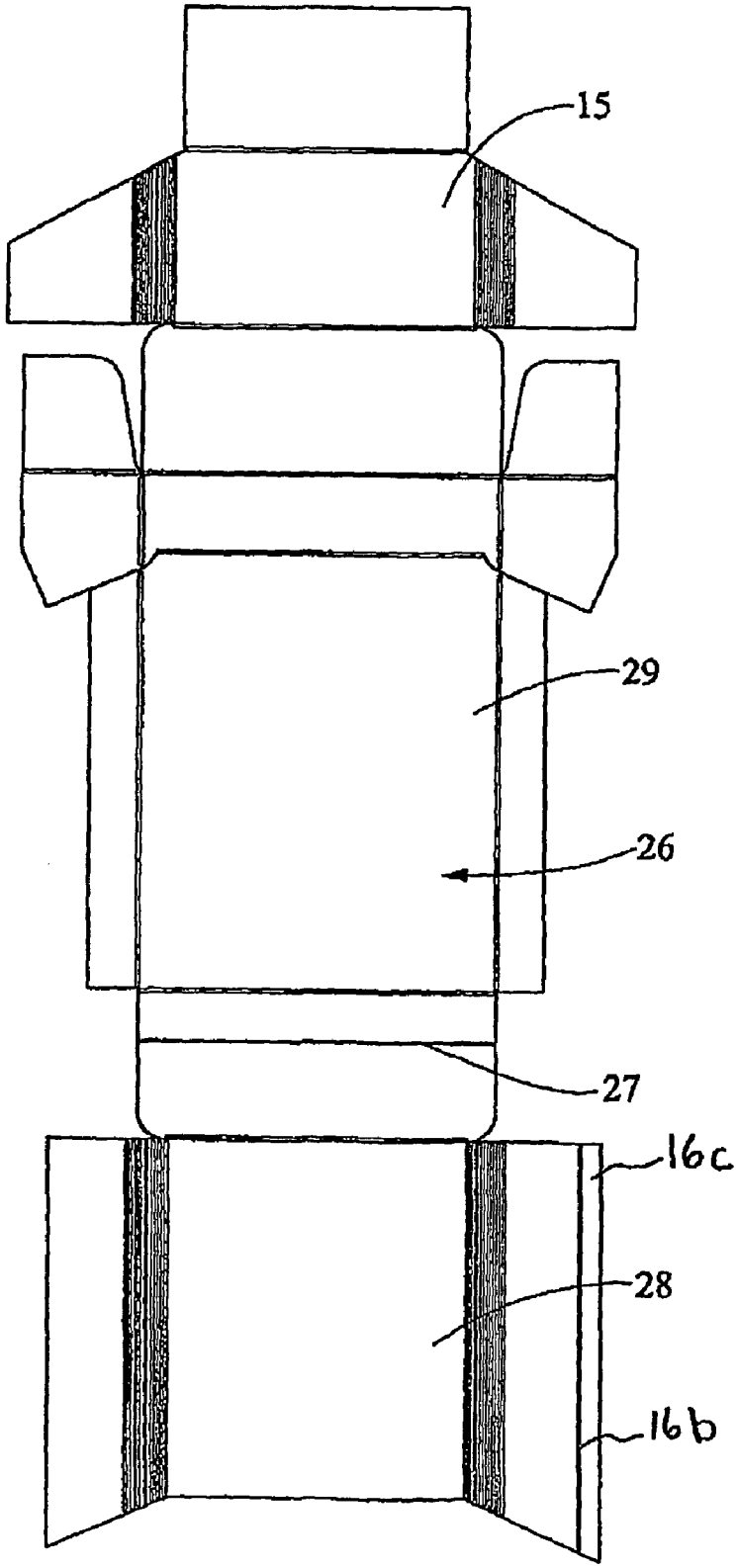
FIG. 4 is a plan view of the outer frame blank member C used by the cigarette wrapping unit of the present invention.
Figure 6:
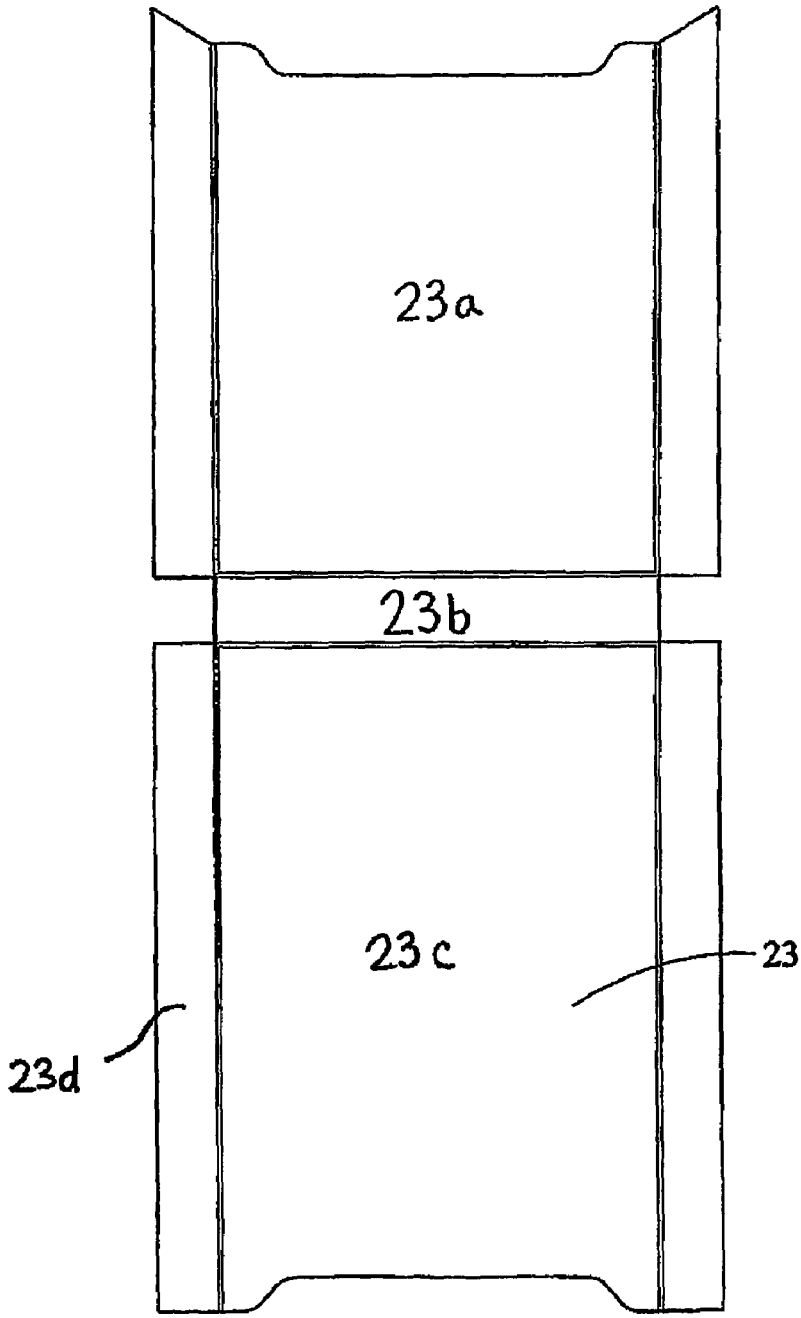
FIG. 6 is a plan view of one of the inner frame members used by the cigarette wrapping unit of the present invention for creating one of the assembled cigarette bundles.

Likewise, the seven's cigarette bundle or pack 12, shown in FIG. 2, is formed in the first cigarette wrapping machine 30 (HLP 1). The inner frame 23 is shown in FIG. 6 wherein the inner frame 23 for the bundle 12 is formed of an inner face 23*a*, bottom wall 23*b* and an outer face 23*c*. Side wall 23*d* is also shown and is constructed so as to adhesively receive the hinge panel 16*c* of the outer frame 26, shown in FIG. 4. Thus, after the two foil wrapped cigarette bundles 12 and 14 are formed, they are placed in face to face (front to front) abutting relationship and then wrapped in the third cigarette wrapping machine 32 (HLP 3) by the outer frame 26, shown in FIG. 4.

The outer frame 26 manipulated by the third cigarette wrapping machine 32 has a cover 29, hinged lid section 16, score or cut line on the bottom wall 27, outer face 28, vertical hinge line 16*b* and hinge panel 16*c*. The third cigarette wrapping machine folds the cover or rear panel 29 about the outer face 23*c* of the seven's inner frame 23 and also forms the hinged lid 15. The bottom wall 27 is folded around the combined bottom walls of the seven's inner frame 23*b* and the bottom wall 22*b* of the thirteen's inner frame. The outer face 28 is adhesively applied to the outer face 22*c* of the thirteen's inner frame 22 whilst the hinge panel 16*c*, as mentioned, is adhesively applied to the side wall 23*d* of the seven's inner frame 23. By so constructing and folding the outer frame 26 around the face to face combined pack assembly 75, shown in FIGS. 11 and 12, the pack 10 of the present invention may be hinged about the vertical hinge line 16*b* allowing the pack to be opened as depicted in FIG. 1. It can also be appreciated that the bottom wall 27 of the outer frame must be appropriately cut so that it can separate as seen and depicted. It is further appreciated that any number of cigarettes in the individual bundles 12 and 14 may be utilised so as to create the vertically hinged pack 10 of the present invention.

Figure 11:
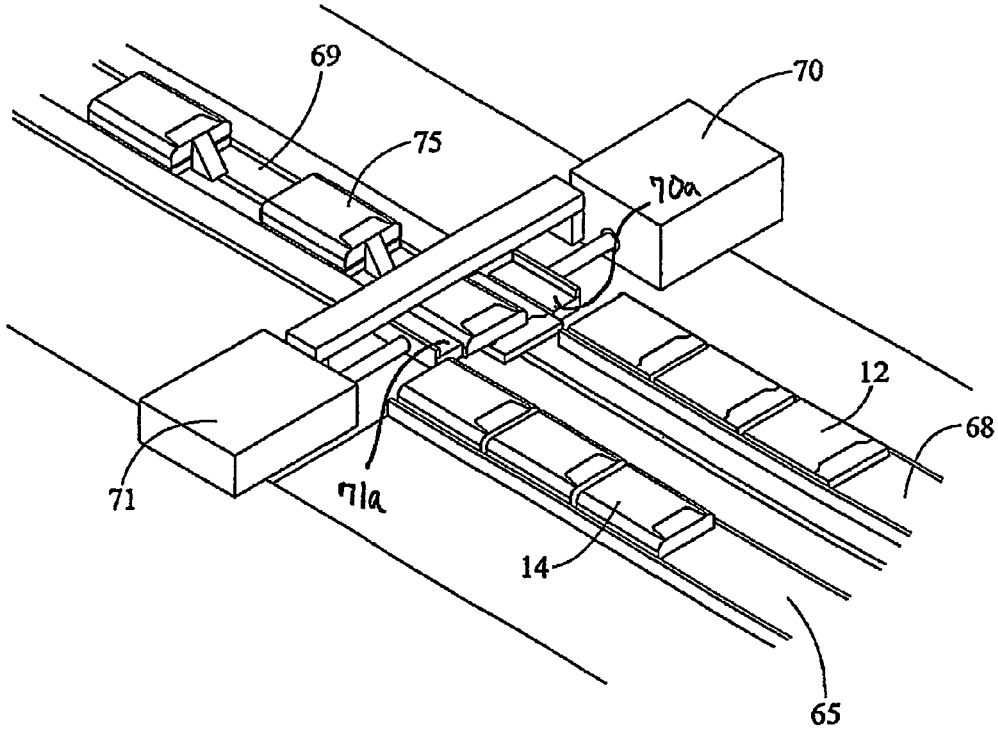
FIG. 11 is a perspective view of the combination station of the present invention for combining the separate wrapped bundles into a single bundle, namely pack assembly AB.
Figure 12:
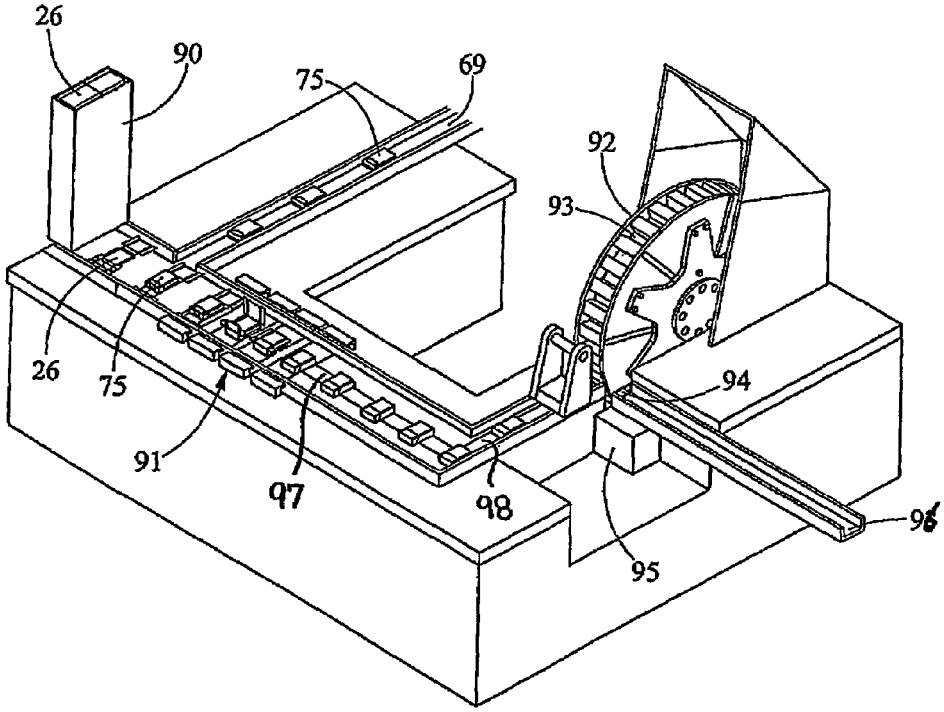
FIG. 12 is a perspective view of the cigarette wrapping machine used in the creation of the outer frame in the present invention.

In HLP 2 machine 31, the finished cigarette bundle 14 with the wrapped carton of inner framed material therearound is inverted on the conveyor at the inverting station 64, shown in FIG. 2, so that the packs are properly aligned face to face. The conveyor turn 66 is formed to flip the pack appropriately prior to the HLP 3 32 machine so that the packs 12 and 14, when combined as depicted in FIG. 11 as combined pack assembly 75, are in face to face relationship on the combined conveyor 69.

The two exit conveyors 65 and 68 representing exit conveyors from the first and the second cigarette wrapping machine 30, 31 are placed in side-by-side relationship as they enter into the combination station. As can be understood, on of the conveyors must be displaced vertically from the other conveyor so that as plungers 70*a* and 71*a* are activated to remove the bundles 12, 14 from each of the conveyors 68 and 65, they are in proper vertical alignment so that they may slide over one another to form the combined cigarette pack assembly 75. Plungers 70*a*, 71*a* activated by actuators 70, 71 are activated from either side of both conveyors 65, 68 to combine the cigarette bundles in face-to-face relationship for subsequent wrapping by the outer carton blank 26. The combined bundles 75 are then passed into HLP 3 32 where they are passed onto the individual stations of the blank conveyor 97 containing the outer frame carton 26. The combined pack assembly 75 are then packaged by the third cigarette wrapping machine 32 as previously mentioned so that the outer frame member 26 provides a vertical hinge line 16*b* between the two separate bundles 12, 14.

In the HLP 3 machine 32, a number of glue application nozzles are provided in the folding and adhesive stations 91. These glue application nozzles may be HHS spray nozzles for spot gluing on the HLP 3 blank conveyor 97. This adhesive is similar to the normal adhesive utilised except that it is more viscous for ready application through the nozzles. Multiple application or nozzles are required in HLP 3 machine 32, approximately 6 in all, for spot application of adhesive to the various corners and positions on the outer frame member 26.

In regards to the outer frame member 26, the outer frame is designed to partially surround the two inner frame wrapped foil lined cigarette bundles 12, 14, while also having a score line along the bottom wall 27 thereof which may be cut so that the formed vertically hinged pack 10 may open along the necessary hinge line 16*b* at the side edges. Thus, upon examination of the outer frame blank 26, a small score line may be provided at the vertical hinge line 16*b*.

The combined pack assembly 75 is passed in to the blank conveyor 97 of the third cigarette wrapping machine 32 (HLP 3) as indicated and the adhesive is applied to the appropriate positions, folding operations are conducted so that the tops and sides are folded appropriately surrounding the two bundles 12, 14 while applying adhesive at the appropriate positions. An examination station may also be provided in the HLP 3 machine in order to examine each package to ensure that the folding operations and adhesive operations have taken place in the folding and adhesive stations 91 and, where appropriate, reject cartons which are identified and then removed from the HLP 3 machine 32.

A transfer conveyor 98 is located at the opposite end of the blank conveyor 97 for moving the formed vertical hinged cigarette package 10 across an adhesive drum for the long side seam adhesive application, along the side panels such as 16*c*, after which the combined and fully formed hinged lid vertically hinged cigarette package 10 is placed into individual pockets 93, similarly as in HLP 1 and HLP 2, of the drying drum 92. At the end of the rotational extent or drying duration of the drying drum 92 and just before the exit aperture 94, a rotary knife or other cutting mechanism 95 may be provided for cutting along the score line or full panel of the bottom wall 27 of the outer frame member 26 or for direct cutting of the full bottom flap. The pack is then forced from the pocket 93 of the drum 92 and moved again to receive another pack. The cutting of the bottom wall 27 is necessary so that the individual cigarette pack 10 may be hinged about the side walls along hinge line 16*b* and may separate at the now cut bottom wall 27. At the exit 94 of the drying drum 92, the individual packs 10 are removed for later handling and placement into cigarette cartons.

In the HLP 3 machine 32, all of the folding operations are necessary for formation of the outer pack or the outer frame is provided. This includes folding of the hinged lid 15 lid and folding the lid over the closed but individually separated cigarette bundles 12, 14.

The HLP 1 machine 30 and HLP 2 machine 31 are initially designed to run at about 140 packs per minute. The foil wrapping system for both HLP 1 and HLP 2 are standard twin foil reel holders with typical rotary cut off and foil perforation units. The foil lining 16 is perforated as is normally conducted using a straight cut knife or serrated knife so that the upper exposed section on both bundles 12, 14 of the foil may be removed by the user. In relation to the blank folding and adhesive stations 59 provided along the blank conveyor 56 of both HLP 1 and HLP 2, standard plough folders and top panel reciprocating folders are utilised. Fold tabs 22*e* may also be placed at the top of the opposing side walls on the outer face 22*c* of the inner frame 22 in order to help maintain the hinged lid 15 in closed position. These folding tabs 22*e* are placed on the inner frame member 22.

The drying drums 61 and 92 utilised in all three machines 30, 31, 32, are forty-eight stage heated drums which are temperature controlled to assure proper drying of the adhesive in the formed packs.

The system of the present invention combines three pieces of machinery, a first cigarette bundle making machine 30, a second cigarette bundle making machine 31 and a third combined outer wrapping machine 32. The system of the present invention provides for creation of two inner frame foil wrapped bundles of cigarettes 12, 14, which are combined in a third wrapping machine 32 that provides an outer frame making apparatus. The first cigarette packing machine 30 creates a foil wrap cigarette bundle surrounded by a first inner frame member 23. The second cigarette packing machine 31 creates a second foil wrapped bundle wrapped in a second inner frame member 22. The first inner frame member 23 and the second inner frame member 22 are subsequently combined into a face to face combined pack assembly 75. In the present example, the second inner frame 22 can contain seven cigarettes and six cigarettes combined for a thirteen cigarette bundle pack 14 while the other cigarette packing machine can create a seven cigarette foil wrapped bundle 12 surrounded by the first inner frame member 23. Both inner frame members with the foil wrap cigarette bundles are then fed into an outer frame carton folding machine 32 which combines the two bundles into a side hinged pack having a hinged lid.

The three machine cigarette packer of the present invention is controlled by a standard operable controlling device such as a PLC or similar electronic controller mechanism for controlling the transfer speeds and production speeds of all three packers. Such electronic controllers are known in the art and various electronic arrangements and embodiments may be utilised to effectuate control of the individual packers set forth herein.

It is apparent that variations to the different cigarette makers are available while still using concepts of the present invention disclosed herein and claimed. Such variations are deemed to fall within the teachings and claims of the present application.

The invention claimed is:

1. An apparatus for forming a cigarette pack comprising a first cigarette wrapping unit, a second cigarette wrapping unit and a third pack combining unit, wherein the first cigarette wrapping unit is operable to assemble a first inner frame blank member A about a first bundle of cigarettes, the second cigarette wrapping unit is operable to assemble a second inner frame blank member B about a second bundle of cigarettes, and the third pack combining unit is operable to assemble an outer blank member C partially about a pack assembly, which pack assembly AB consists essentially of assembled blank members A and B each containing a bundle of cigarettes.

2. An apparatus according to claim 1, wherein said first cigarette wrapping unit, second cigarette wrapping unit and the third pack combining unit are separate cigarette packing machines.

3. An apparatus according to claim 1, wherein the first and the second cigarette wrapping units are combined to provide a single unit operable to assemble a first inner blank member A about a first bundle of cigarettes and a second inner blank member B about a second bundle of cigarettes.

4. An apparatus according to claim 1, wherein the third pack combining unit is configured to receive the first assembled cigarette bundle and the second assembled cigarette bundle in face-to-face overlaying relationship.

5. An apparatus according to claim 4, said outer frame member C having a hinge line along a mating side edge of the first assembled cigarette bundle and the second assembled cigarette bundle.

6. An apparatus according to claim 1, wherein in advance of either of inner frame blank members A or B being assembled about the first or the second bundle of cigarettes respectively, the bundle of cigarettes is wrapped in a wrapping material.

7. An apparatus according to claim 6, wherein the wrapping material is foil.

8. An apparatus according to claim 1, wherein the first cigarette wrapping unit is configured to form a bundle of thirteen cigarettes.

9. An apparatus according to claim 1, wherein the second cigarette wrapping unit is configured to form a bundle of seven cigarettes.

10. An apparatus according to claim 1, wherein the first cigarette wrapping unit and the second cigarette wrapping unit each comprise a cigarette receiving station, a wrapping station, an inner frame blank conveyor, a folding station and a transferring conveyor.

11. An apparatus according to claim 10, wherein the first cigarette wrapping unit and the second cigarette wrapping unit further comprise a drying drum.

12. An apparatus according to claim 10, wherein in the first and the second cigarette wrapping unit, the wrapped bundle of cigarettes is conveyed to the folding station in the inner frame blank conveyor.

13. An apparatus according to claim 12, wherein the first and/or the second cigarette wrapping machine further comprise an indexed advancing mechanism whereby the wrapped bundle of cigarettes is advanced into the folding station.

14. An apparatus according to claim 10, wherein the first and the second cigarette wrapping units further comprise a blank feed from which, in use, an inner frame blank member A or B is conveyed into the folding station in the inner frame blank conveyor.

15. An apparatus according to claim 10, wherein the folding station comprises a rounded pocket, a square pocket or a bevelled pocket.

16. An apparatus according to claim 10, wherein the first cigarette wrapping unit or the second cigarette wrapping unit further comprises an inverting station, whereby the assembled cigarette bundle is inverted before being conveyed by the transfer conveyor to the third pack combining unit.

17. An apparatus according to claim 10, wherein the transfer conveyors of the first cigarette wrapping unit and the second cigarette wrapping machine are each operable to convey the assembled cigarette bundles to the third pack combining unit.

18. An apparatus according to claim 17, wherein the transfer conveyors of the first cigarette wrapping unit and the second cigarette wrapping unit are adjacent one another in offset, parallel relation.

19. An apparatus according to claim 18, wherein the transfer conveyor of the second cigarette wrapping unit is positioned to be lower than the transfer conveyor of the first cigarette wrapping machine.

20. An apparatus according to claim 18, wherein the transfer conveyor of the first cigarette wrapping machine is positioned lower than the transfer conveyor of the second cigarette wrapping machine.

21. An apparatus according to claim 10, wherein the transfer conveyors of the first and the second cigarette wrapping units each further comprise sensors whereby the sensors are operable to detect a shortage of assembled cigarette bundles A and/or B on the transfer conveyors.

22. An apparatus according to claim 21, wherein the sensors are in communication with the first and second cigarette wrapping units and the third pack combining unit such that the operating speeds of the units are controllable in accordance with a supply-demand relationship for the assembled cigarette bundles in each of the three units.

23. An apparatus according to claim 1, wherein the third pack combining unit comprises a conveyor transfer station having a first transfer plunger and a second transfer plunger, the first transfer plunger crossing a conveyor line from the first cigarette wrapping unit, the second transfer plunger crossing a conveyor line from the second cigarette wrapping unit, whereby both the first and the second transfer plungers are operable to deposit assembled cigarette bundles A and/or B onto a combination conveyor thereby forming pack assembly AB.

24. An apparatus according to claim 1, wherein the third pack combining unit comprises a blank feed from which an outer frame blank member C is fed into a folding station.

25. An apparatus according to claim 1, wherein the third pack combining unit farther comprises a cutting device which cutting device is operable to cut the outer frame blank member C along the bottom wall thereof to allow opening of the pack.

26. An apparatus according to claim 25, wherein the cutting device is a knife.

27. An apparatus according to claim 1, wherein the third pack combining unit farther comprises an end sealing device.

28. An apparatus according to claim 27, wherein the end sealing device is a foam belt.

29. An apparatus according to claim 27, wherein the end sealing device is a continuous belt.

30. A method of assembly of a cigarette pack, the method comprising forming a first wrapped bundle of cigarettes having a first inner frame member A, forming a second wrapped bundle of cigarettes having a second inner frame member B, transporting said first wrapped bundle of cigarettes and said second wrapped bundle of cigarettes to a pack combining unit in combined relationship as a pack assembly AB, and assembling an outer frame blank member C partially about the pack assembly AB.

31. A method according to claim 30, wherein the first wrapped bundle of cigarettes having a first inner frame member A is formed on a first cigarette wrapping unit in which a first bundle of cigarettes is wrapped in a wrapper, a first inner blank member A is fed to a folding station in the first cigarette wrapping unit and partially erected, the first wrapped bundle of cigarettes is plunged into the partially erected first inner blank member A, and the partially erected first inner blank member A is completely erected about the first wrapped bundle of cigarettes.

32. A method according to claim 30, wherein the second wrapped bundle of cigarettes having a second inner frame member B is formed on a second cigarette wrapping unit in which a second bundle of cigarettes is wrapped in a wrapper, a second inner blank member B is fed to a folding station in the second cigarette wrapping unit and partially erected, the second wrapped bundle of cigarettes is plunged into the partially erected second inner blank member B, and the partially erected second inner blank member B is completely erected about the second wrapped bundle of cigarettes.

33. A method according to claim 30, wherein the outer blank member C is formed partially about pack assembly AB on the third pack combining unit by partially erecting outer blank member C, plunging pack assembly AB into the partially erected outer blank member C and erecting the outer blank member C partially about the pack assembly AB.

34. A method according to claim 33, wherein when outer blank member C is partially erected about pack assembly AB, a vertical hinge panel of the outer blank member C is adhesively applied to the first assembled cigarette bundle of pack assembly AB thereby allowing the pack assembly AB to hinge about a vertical hinge line.

35. A method according to claim 30, farther comprises cutting through a bottom panel of the outer blank member C to allow the first assembled cigarette bundle and the second assembled cigarette bundle to separate about a vertical hinge line.

36. A method according to claim 30, wherein the first assembled cigarette bundle comprises seven cigarettes.

37. A method according to claim 30, wherein the second assembled cigarette bundle comprises thirteen cigarettes.

38. A method according to claim 30, wherein the first and the second assembled cigarette bundles further comprise a wrapping material wrapped about the bundle of cigarettes within the inner frame thereof.

39. A method according to claim 38, wherein the wrapping material is a foil.

40. A method according to claim 30, wherein the cigarette pack is a hinged lid side-by-side vertically hinged cigarette pack.

41. A system providing a cigarette packing machine, the machine consisting of three separate units, a first cigarette bundle wrapping unit, a second cigarette bundle wrapping unit and a third pack combining unit which partially surrounds said first and second cigarette bundles with an outer frame.

42. A system according to claim 41, wherein the system provides for creation of a first and a second foil wrapped cigarette bundle and wherein said outer frame has a hinged lid.

* * * * *